US005457263A

United States Patent [19]

Berglund

[11] Patent Number: 5,457,263

[45] Date of Patent: Oct. 10, 1995

[54] METHOD FOR CONTAINING RADIOACTIVE WASTE

[75] Inventor: Jerry W. Berglund, Placitas, N.M.

[73] Assignee: University of New Mexico, Albuquerque, N.M.

[21] Appl. No.: 194,863

[22] Filed: Feb. 14, 1994

[51] Int. Cl.[6] ..... G21F 9/00

[52] U.S. Cl. ..... 588/3; 588/16; 264/69; 264/257; 264/259; 264/263

[58] Field of Search ..... 588/3, 4, 16; 250/506.1; 376/272; 252/625; 264/69, 241, 259, 263, 257

[56] References Cited

U.S. PATENT DOCUMENTS

| | | | |
|---|---|---|---|
| 4,257,912 | 3/1981 | Fleischer et al. | 588/16 |
| 4,594,513 | 6/1986 | Suzuki et al. | 250/506.1 |
| 4,687,614 | 8/1987 | Suzuki et al. | 264/40.1 |
| 4,996,019 | 2/1991 | Catalayoud et al. | 376/272 |
| 5,100,586 | 3/1992 | Jennings et al. | 252/629 |
| 5,225,114 | 7/1993 | Anderson et al. | 588/16 |
| 5,256,338 | 10/1993 | Nishi et al. | 588/4 |

OTHER PUBLICATIONS

David R. Lankard; Slurry Infilitrated Fiber Concrete; Dec. 1984; pp. 44–47.

David R. Lankard; Preparation, Properties . . . ; Jun. 1985; pp. 199–217.

Jerry W. Berglund; Experimental Mechanics; Sep. 1988; pp. 281–287.

Sogefibre; The Fiber Concrete Overpack (No Date).

*Primary Examiner*—Ngoclan Mai

*Attorney, Agent, or Firm*—Al Sopp; Robert Becker

[57] ABSTRACT

A method of producing a concrete container for storage of radioactive waste includes the steps of providing a double-walled mold with an inner and an outer wall, the mold being open at the top and having an interior for receiving the radioactive waste. The space between the inner and the outer walls is filled with fibers. Subsequently, a concrete mixture is filled into the space between the inner and the outer walls to a level below the uppermost layer of fibers. The interior is closed off by a cover plate. After placing more fibers onto the cover plate a concrete mixture is poured onto the fibers until they are completely covered. Alternatively, it is possible to place a cover plate onto the inner wall for closing of the interior after insertion of the radioactive waste, fill the space between the inner and the outer walls with fibers, and place additional fibers onto the cover plate. Subsequently, the concrete mixture is poured in one step into the space between the inner and the outer walls and onto the fibers until the fibers are covered completely.

42 Claims, 14 Drawing Sheets

METHOD FOR CONTAINING RADIOACTIVE WASTE

BACKGROUND OF THE INVENTION

The present invention relates to a container for storage of radioactive waste and a method for producing the container.

Containers or vaults for storing radioactive waste must be able to isolate the radioactive waste from the environment for very long periods of time, for example, hundreds and thousands of years. Although the containers will usually remain undisturbed while being stored, there are periods when the vault or container must be moved and handled, for example, for placing into storage or moving to a different location, and is thus subject to accidental damage. Therefore, these containers must be able to withstand without breaking substantial shock loading caused by mishandling or dropping. Furthermore, the container must be able to withstand impact of heavy objects in case the building or structure in which the containers are stored collapses due to earthquakes or other external destructive forces. Moreover, it must also be ensured that the deliberate attempt to destroy a container cannot lead to a destruction or breakage of the container and, in this regard, the container must be able to withstand severe ballistic load or blast loads of explosives.

Another consideration is that of radiation shielding. Ideally, the storage container should be able to shield the environment more or less completely from radiation Generated by the stored radioactive waste.

These two properties, structural integrity and radiation shielding, require a container wall material that can absorb radiation and impact and that has a high fracture toughness and ballistic or blast resistance.

A material that has both of these features is slurry-infiltrated fiber concrete (SIFCON), disclosed, for example, in Concrete International, pp. 44–47, Dec. 1984, and in "Preparation, Properties and Applications of Cement-based Composites Containing 5 to 20 Percent Steel Fiber", Steel Fiber Concrete US-Sweden Joint Seminar, ed. S. P. Shah and A Skarendahl, Elsevier Science Publishers, 1985. SIFCON is a relatively new composite material that consists of short steel or other metal fibers embedded in a cement matrix of Portland cement. Unlike conventional fiber-reinforced concrete in which fibers are added to a concrete mixture resulting in a volume percent range of metal of 0.5 to 1.5%, SIFCON allows for the introduction of a considerably higher volume percentage of metal fibers within the cement matrix. SIFCON is produced by preparing a bed of preplaced fibers in the range of 5 to 30% by volume. The resulting fiber bed is then infiltrated with a low viscosity cementitious slurry. The cured metal fiber/cement composite possesses very high flexural and compressive strength as well as toughness and ductility. It has been demonstrated that SIFCON is highly resistant to blast loads and ballistic and fragment penetration. With the proper selection of fibers, SIFCON will also provide substantial radiation protection.

A fiber-reinforced concrete container for the storage of radioactive waste is known and produced by a company called Sogefibre (1, Rue des Herons, Montigny-Le-Bretonneux, 78182 Saint Quentin-Yvelines, Cedex, France). A highly corrosion-resistant, non-crystalline metal fiber Fibraflex is used in the concrete mixture. The containers can be cylindrical or cubical. The containers are manufactured by molding from a premixed fiber/concrete mix the bottom and the sidewalls in a single step and by molding a separate lid that is to be placed on the container after introduction of the radioactive waste. The lid must then be connected to the upward edges of the sidewalls by sealing the gap between the sidewalls and the lid with a fiber-concrete mixture and curing. A drawback of these containers is the seal between the lid and the container because the so-called cold joint between sidewalls and lid represents a discontinuity of the concrete enclosure that is prone to rupture or break when the container is subjected to impact or stress.

A further disadvantage of the known container is that fibers and the cementitious mixture are mixed to form a slurry that is then poured into the mold. By mixing fiber and the cementitious mixture, the amount of fibers that can be introduced into the concrete slurry is limited in order to maintain flowability of the concrete mix. In general, the amount of fibers is limited to 2 to 3% by volume. This also results in a much reduced reinforcement since the amount of fiber in the cement is substantially proportional to the attained reinforcement strength. Another often observed disadvantage of fiber/concrete premixtures is the non-uniform distribution of the fibers within the concrete: commonly, pockets of high density of fiber distribution are observed while other areas have a very low density of fiber distribution. This causes an uneven reinforcement with weak points.

It is therefore an object of the present invention to provide a container and a method for producing such a container with which the aforementioned disadvantage of having a weak point in the concrete enclosure is eliminated.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
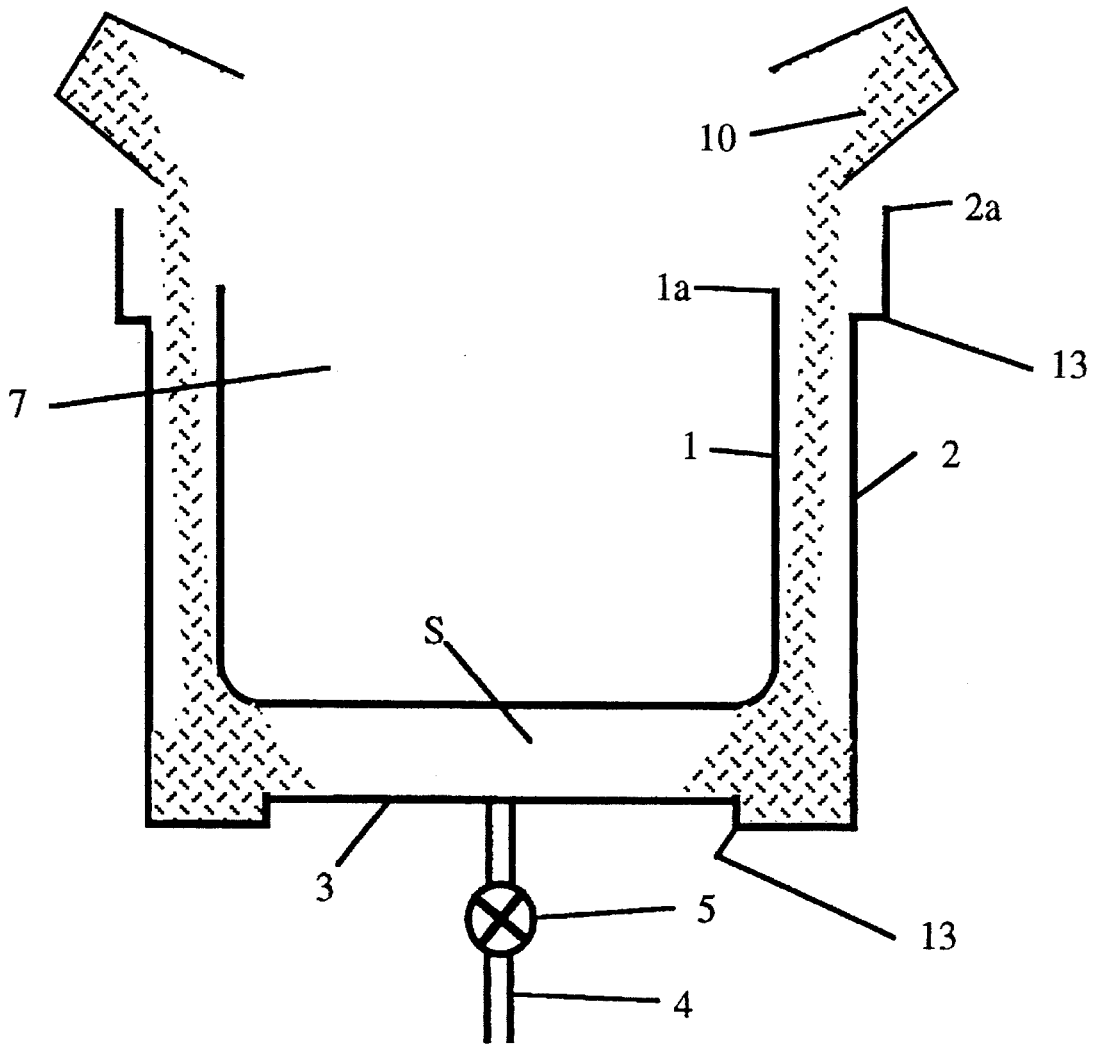
FIG. 1 is a schematic representation of a mold being filled with fibers.

The first method of producing a concrete container for storage of radioactive waste according to the present invention is primarily characterized by the following steps:

Providing a double-walled mold with an inner and an outer wall, the mold being open at the top and having an interior for receiving the radioactive waste;

Filling the space between the inner and the outer walls with fibers;

Filling concrete mixture into the space between the inner and the outer walls to a level below the uppermost layer of the fibers;

Closing off the interior with a cover plate;

Placing more of the fibers onto the cover plate; and

Pouring concrete mixture onto the fibers until covered completely.

Preferably, the inventive first method further comprises the step of vibrating the mold after the step of filling the space between the inner and outer walls with fibers for increasing the density of fiber distribution to a range of 5 to 30% by volume.

Advantageously, the first method further comprises the step of vibrating the mold after the step of placing more of the fibers onto the cover plate for increasing the density of fiber distribution to a range of 5 to 30% by volume.

Expediently, the inventive first method further comprises the step of curing the concrete mixture after the step of filling concrete mixture into the space between the inner and the outer walls to a level below the uppermost layer of the fibers. Preferably, the method further comprises the step of removing the inner wall after the step of curing the concrete mixture.

Advantageously, the first method further comprises the step of curing the concrete mixture after the step of pouring concrete mixture onto the fibers until covered completely. Preferably, the method further comprises the step of removing the outer wall after curing of the concrete mixture.

Preferably, the outer wall projects upwardly past the inner wall.

Advantageously, the first method further comprises the step of connecting an inlet line with a shut-off valve to the bottom of the mold.

In a preferred embodiment of the first method of the present invention, the step of filling concrete mixture into the space between the inner and the outer walls to a level below the upper most layer of fibers includes the step of introducing the concrete mixture through the inlet line.

Preferably, the first method further comprises the step of introducing the radioactive waste into the interior before the step of positioning a cover plate onto the inner wall for closing of the interior. Expediently, the method further comprises the step of encapsulating the radioactive waste with cementitious material in the interior.

Preferably, the first method in a further embodiment comprises the step of introducing the radioactive waste into the interior before the step of filling the space between the inner and the outer walls with fibers. In the alternative, the method comprises the step of introducing the radioactive waste into the interior after the step of filling the space between the inner and the outer walls with fibers.

Preferably, the inner wall and/or the outer wall are made of a radiopaque material. The cover plate may also be made of radiopaque material.

Expediently, the first method further comprises the step of positioning an attachment element within the fibers, preferably between the inner and outer walls before the step of pouring concrete onto the fibers until covered completely.

Advantageously, the first method further comprises the step of vibrating the mold after the step of filling concrete mixture into the space between the inner and the outer walls to a level below the uppermost layer of the fibers.

Preferably, the first method further comprises the step of vibrating the mold after the step of pouring concrete onto the fibers until covered completely.

In another embodiment of the present invention, the first method further comprises the step of providing the cover plate with at least one access port extending through the concrete mixture poured onto the cover plate.

Preferably, the first method further comprises the step of vibrating the mold during the step of filling the space between the inner and the outer walls with fibers.

In a preferred embodiment of the present invention, the first method further comprises the step of producing recessed portions on the exterior of the container for lifting and transporting.

Advantageously, the first method further comprises the step of producing projections on the exterior of the container for lifting and transporting.

Preferably, the projections are attachment elements molded into the concrete mixture.

A second method of the present invention is primarily characterized by the following steps:

Providing a double-walled mold with an inner and an outer wall, the mold being open at the top and having an interior for receiving the radioactive waste;

Placing a cover plate onto the inner wall for closing of the interior;

Filling the space between the inner and the outer walls with fibers and placing fibers onto the cover plate; and Filling concrete mixture into the space between the inner and the outer walls and onto the fibers on the cover plate until the fibers are covered completely.

Advantageously, the second method further comprises the step of introducing the radioactive waste into the interior before the step of filling the space between the inner and the outer walls with fibers. In the alternative, the method comprises the step of introducing the radioactive waste into the interior after the step of filling the space between the inner and outer walls with fibers. In both cases it is possible to further include the step of encapsulating the radioactive waste with cementitious material in the interior.

Advantageously, the second method further comprises the step of vibrating the mold after the step of filling the space between the inner and the outer walls with fibers for increasing the density of fiber distribution to a range of 5 to 30% by volume. Preferably, the second method also comprises the step of vibrating the mold after the step of placing fibers onto the cover plate for increasing the density of fiber distribution to a range of 5 to 30% by volume.

Preferably, the second method according to the present invention further comprises the step of curing the concrete mixture after the step of filling concrete mixture into the space between the inner and the outer walls and onto the fibers on the cover plate until the fibers are covered completely. Preferably, the second method also includes the step of removing the outer wall after curing of the concrete mixture.

Preferably, the outer wall projects upwardly past the inner wall. Expediently, the second method further comprises the step of connecting an inlet line with a shut-off valve to the bottom of the mold. Expediently, the step of filling concrete mixture into the space between the inner and the outer walls and onto the fibers until the fibers are covered completely includes the step of introducing the concrete mixture through the inlet line.

Advantageously, the inner wall and/or the outer wall are made of a radiopaque material. It is also possible to make the cover plate of radiopaque material.

Expediently, the second method further comprises the step of positioning an attachment element within the fibers, preferably between the inner and outer walls before or during the step of filling concrete mixture into the space between the inner and the outer walls and onto the fibers on the cover plate until the fibers are covered completely, the attachment element projecting from the concrete mixture after filling.

Preferably, the second method further comprises the step of vibrating the mold after the step of filling concrete mixture into the space between the inner and the outer walls and onto the fibers on the cover plate until the fibers are covered completely.

Advantageously, the second method also includes the step of providing the cover plate with at least one access port extending through the concrete mixture after filling.

Preferably, the second method also includes the step of vibrating the mold during the step of filling the space between the inner and the outer walls with fibers.

Expediently, the second method further comprises the step of producing recessed portions on the exterior of the container for lifting and transporting. It is also possible to produce projections on the exterior of the container for lifting and transporting. Preferably, the projections are attachment elements molded into the concrete mixture.

The present invention also relates to a concrete container for storage of radioactive waste, produced by a first method comprising the steps of:

Providing a double-walled mold with an inner and an outer wall, the mold being open at the top and having an interior for receiving the radioactive waste;

Filling the space between the inner and the outer walls with fibers;

Filling concrete mixture into the space between the inner and the outer walls to a level below the uppermost layer of the fiber;

Closing off the interior with a cover plate;

Placing more fibers onto the cover plate; and

Pouring concrete mixture onto the fibers until covered completely.

The present invention also relates to a concrete container produced according to a second method comprising the steps of:

Providing a double-walled mold with an inner and an outer wall, the mold being open at the top and having an interior for receiving the radioactive waste;

Placing a cover plate onto the inner wall for closing of the interior;

Filling the space between the inner and the outer walls with fibers; and placing fibers onto the cover plate; and Filling concrete mixture into the space between the inner and the outer walls and onto the fibers on the cover plate until the fibers are covered completely.

According to the present invention two methods are provided for producing concrete containers for storage of radioactive waste.

According to the first two-phase process the container is partially manufactured in a first phase of the process followed by the in-place forming of the container cover after the container has been filled with the radioactive waste material to be stored therein. The two-phase process produces a single unit eliminating the cold joint that is the potentially weak connection of the prior art containers. In the first phase of the two-phase process the mold is filled with concrete mixture to a level below the uppermost layer of the fiber filling so that fibers project from the concrete mixture within the mold and are intermixed with loose unbonded fibers in the uppermost layer. In the second phase of the process more fibers are added and intermixed with the already present fibers above the concrete mixture thereby providing a continuous fiber lattice for the concrete container. The concrete mixture poured onto the cover and the fibers in the second phase of the process thus can form a strong bond to the already poured and optionally cured concrete due to the fibers embedded in and projecting from the concrete mixture of the first phase of the process. The continuous fiber lattice within the concrete container thus eliminates weak points and greatly reduces the potential for breakage under impact.

The second inventive process is a single-phase process which completely eliminates the cold joint between cover and container by employing a single pouring or filling step for the concrete mixture.

Vibration is used throughout both processes in order to increase, on the one hand, the density of the fiber distribution within the mold and, on the other hand, after filling the concrete mixture into the mold, to eliminate voids within the concrete mixture.

Fibers to be used in the concrete mixture preferably have a length of 10 to 100 mm, most preferred 20 to 30 mm. The preferred material for the fibers is steel, especially a high-carbon steel, fibers made of a radiation-absorbing material, or any other suitable metals that are known to a person skilled in the art for reinforcement of concrete materials. It is also possible to use ceramic fibers.

The cement mixture to be used in the method of the present invention may be any suitable cementitious material containing, for example, silica fume, Portland cement, fly ash, and other additives known to a person skilled in the art.

The mold may be made of any suitable material such as wood, steel, or any other suitable metal or alloy commonly used for molds whereby it is possible to use the inner wall (inner support) and/or the outer wall (outer support) as additional radiation protection means.

Preferably, the mold is provided with an inlet at the bottom through which the concrete mixture can be pumped into the mold. This assures a substantially void-free distribution of the concrete throughout the fiber lattice. Of course, it is also possible to simply pour the concrete mixture in from the top. In both cases it must be ensured that the concrete mixture is of a viscosity low enough to penetrate the fiber lattice completely without forming voids.

Curing of the concrete mixture to a degree at which it is safe to handle the containers is commonly attained after a period of 21 to 30 days.

Instead of using a concrete or cement-based material it is also possible to use any polyester or epoxy resin that is impact-resistant and would withstand the possible loads described above.

As an additional safety measure it is advantageous to immobilize the waste material within the container. For this purpose, the cover may be provided with access ports for filling the interior of the container with a cementitious or other suitable immobilization material. Such access ports, of course, may also be used for monitoring the waste material stored in the container. It is, of course, also possible to fill the cementitious or other suitable immobilization material into the interior before placing the cover plate on top.

The containers are preferably designed to be stackable and can have any shape such as a cylindrical shape, a cubical shape, a parallelepipedal shape, a polyhedral shape etc. The container size may vary according to specific embodiments: small containers for enclosing a waste barrel are conceivable as well as larger containers for storing a plurality of barrels or other containment means.

In order to facilitate handling and transporting of the containers, special attachment elements may be molded or cast into the concrete mixture during the manufacturing process. It is also possible to provide the exterior of the container with recesses/grooves or projections at the bottom or the sides for engagement by respective lifting and transporting apparatus.

DESCRIPTION OF PREFERRED EMBODIMENTS

The present invention will now be described in detail with the aid of several specific embodiments utilizing FIGS. 1 through 14.

FIG. 1 shows schematically a mold to be used for the single-phase or two-phase process of the present invention. The mold is comprised of an inner and an outer wall 1, 2 spaced apart from one another and secured relative to one another by known means whereby the outer wall 2 is preferably provided at the bottom 3 with an inlet line 4 having a shut-off valve 5. Through the inlet line 4 the cement or concrete slurry (concrete mixture) may be pumped into the mold from the bottom.

The mold may be made of any suitable material. It is possible to reuse the mold, if the material of the mold is selected properly. Alternatively, a single-use mold may be employed.

It is also possible to provide the exterior wall with recesses/grooves or projections 13 at the bottom or the sides for engagement by lifting and transporting devices.

In the first step of the two-phase process fibers 10 are introduced into the mold space S defined between the inner and outer walls 1 and 2. During or after the filling step the mold is vibrated in order to ensure a great fiber distribution density, preferably within the range of 5 to 30%, more preferred in the range of 10 to 15%.

Figure 2:
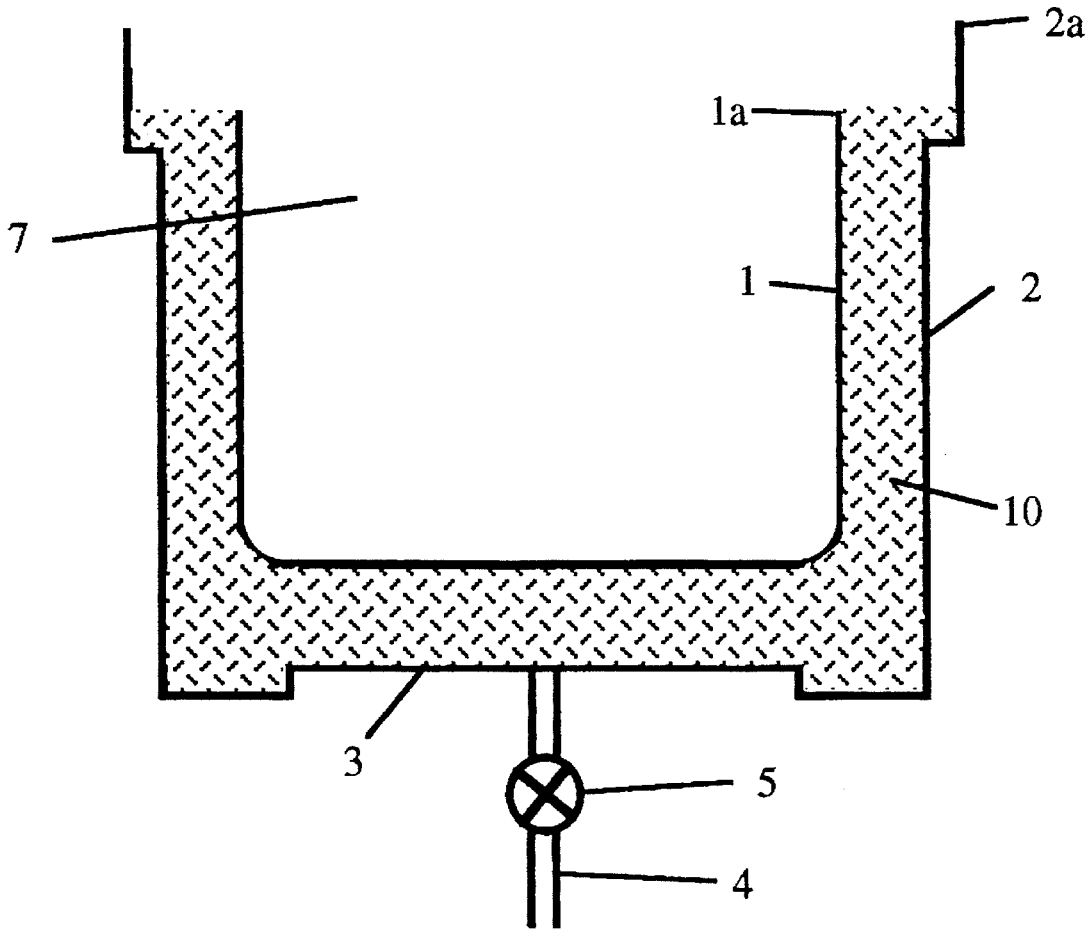
FIG. 2 shows the mold filled with fibers to a first level.
Figure 3:
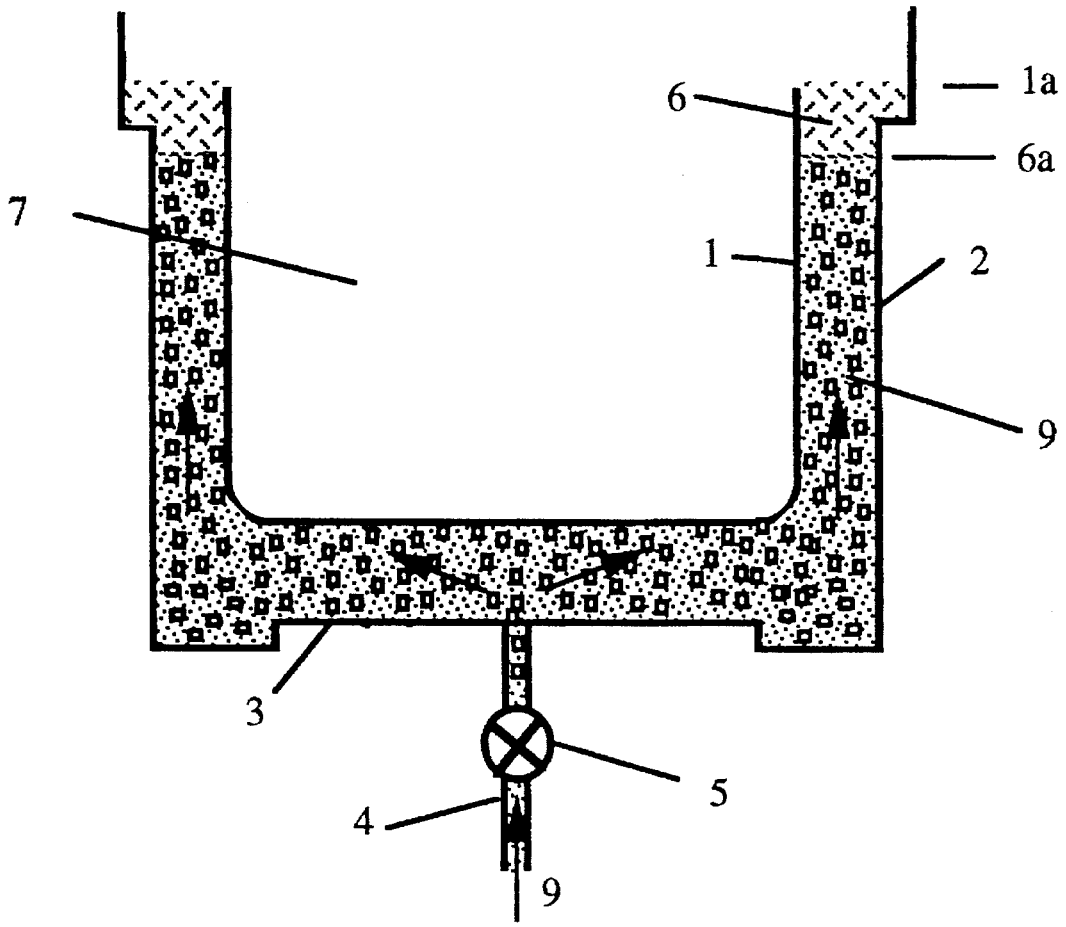
FIG. 3 shows the introduction of a concrete slurry into the mold from the bottom.

After vibrating and settling of the fibers within the mold to a level corresponding to the upper edges 1*a* of the inner wall, the mold is ready to be filled with the concrete slurry (FIG. 2). FIG. 3 schematically shows the filling step wherein the concrete slurry 9 is introduced through the inlet line 4 and the shut-off valve 5 from the bottom 3 into the space S between the inner and outer walls 1 and 2 thereby infiltrating the fiber lattice and filling the empty space between the fibers. According to the present invention, the cementitious material or concrete mixture 9 is filled to a level 6*a* which is at a short distance below the upper filling level of the fibers so that an upper layer of fibers 6 remains exposed. The distance between the level 6*a* and the upper edge 1*a* is determined by the length of the fibers. It should be ensured that the uppermost layer of fibers remain free and unbonded to the concrete mixture.

The concrete mixture to be used according to the present invention is a low viscosity cementitious slurry in order to ensure that all the voids between the fibers are filled completely. In order to further improve the filling of the voids, the mold is vibrated so that air enclosures are forced to the top of the cement mixture for dissipation. The concrete mixture in the mold is then allowed to set and cure.

In the next step of the inventive process the radioactive waste 11 is introduced into the interior of the mold. In the embodiment shown in FIG. 4 the inner wall of the mold remains in place. This is especially advantageous when the inner wall 1 is made of a material that is radiopaque so that in addition to the fiber/cement mixture forming the container an additional protection against radioactive leakage is provided. Radiopaque materials are well known to a person skilled in the art and need not be listed here.

It is, of course, also possible to remove the inner wall 1 of the mold after curing of the concrete and, for example, reuse the inner support or inner wall for a future molding process.

Figure 4:
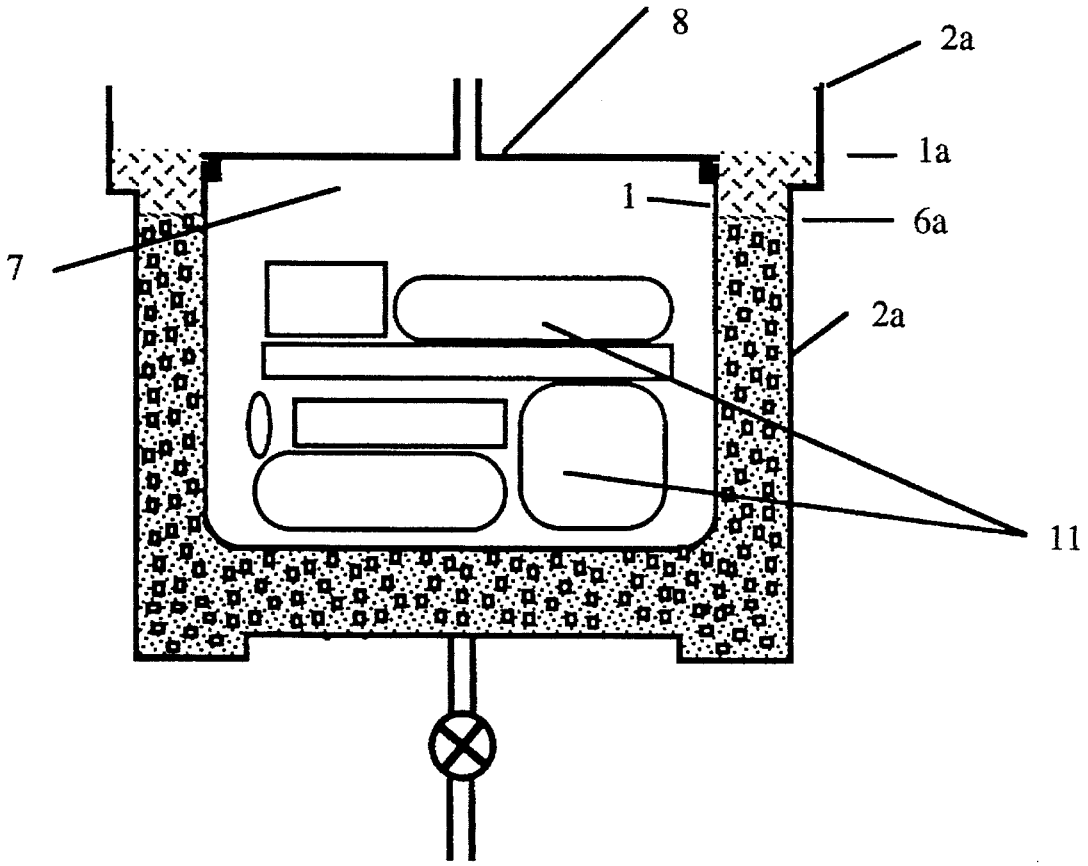
FIG. 4 shows the introduction of radioactive waste into the interior and the closure of the interior by a cover plate.

After insertion or introduction of the waste 11 into the interior 7 of the container, a cover plate 8 is placed on top of the structure to close off the interior. The cover plate 8 may rest on top of the inner wall, as shown in FIG. 4, or on the upper layer of the fibers when the inner wall or support 1 has been removed.

Figure 5:
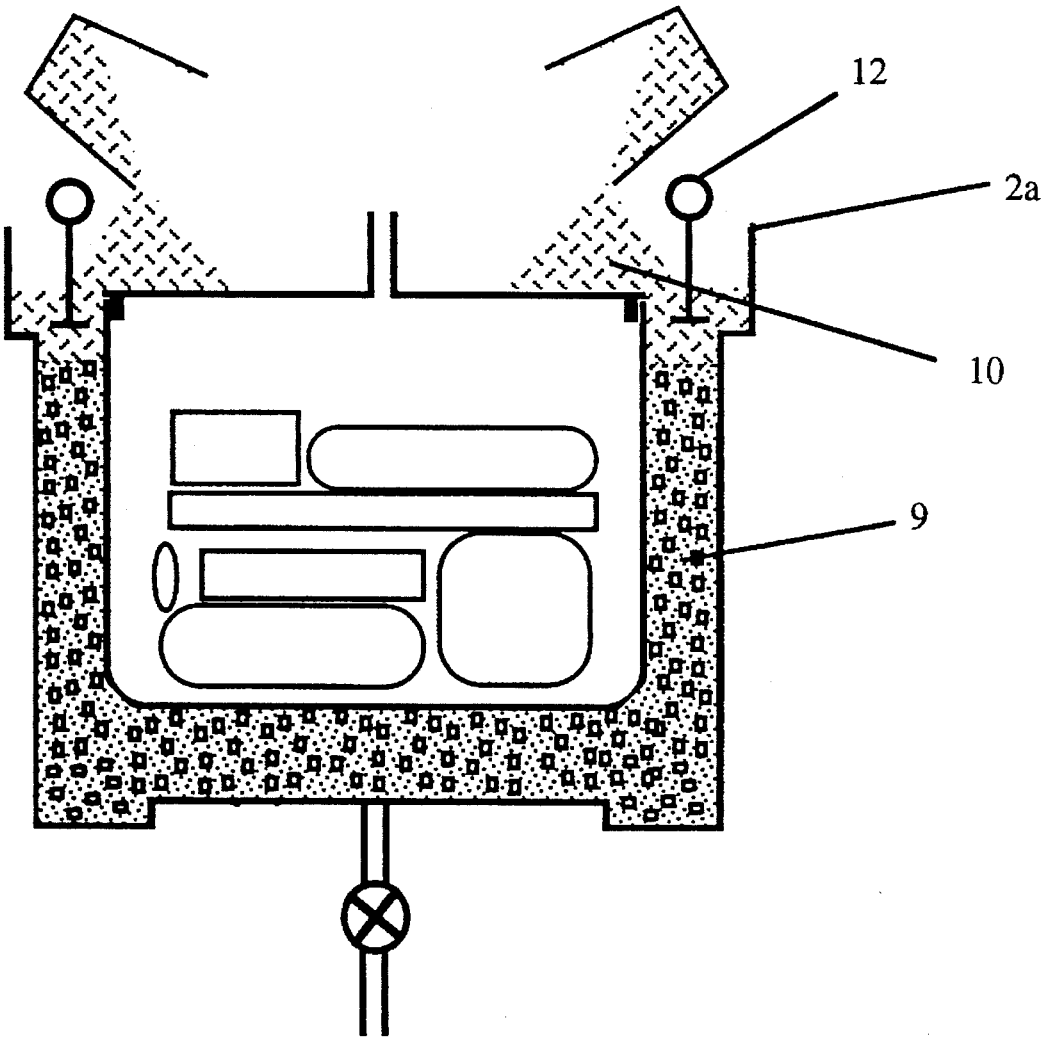
FIG. 5 shows the placement of additional fibers on top of the cover plate.
Figure 6:
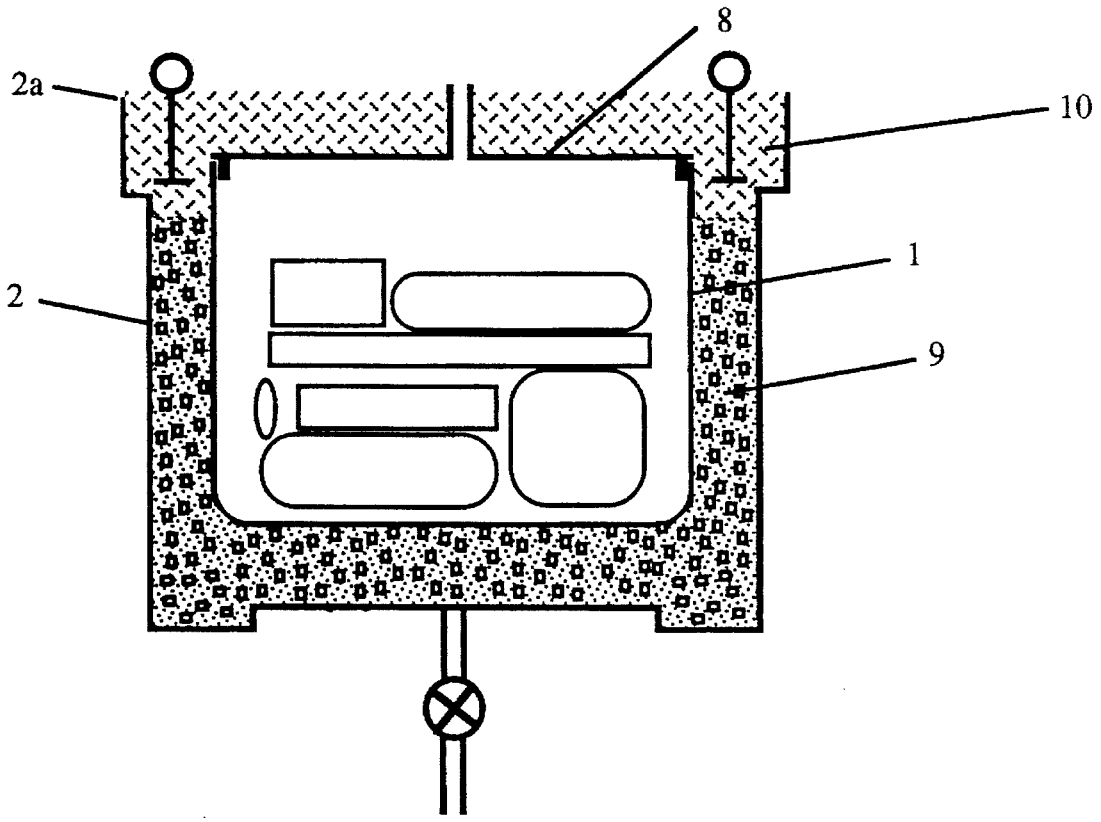
FIG. 6 shows the mold filled with fibers to the upper edge.

In the subsequent step of the first method of the present invention, more fibers are placed on top of the cover plate 8 and the mold is filled with fibers to the rim 2*a* of the outer wall 2 as shown in FIG. 5. Attachment devices 12 can also be placed into the fibers at this time. In order to ensure a uniform distribution of the fibers and to ensure an intermixing of the newly added fibers with the loose and fixed fibers projecting from the cured concrete and also to increase the fiber density of the fiber distribution in the upper portion of the mold, the mold is vibrated during adding of the fibers or after placement of the fibers. FIG. 6 shows the mold after completion of the addition of the fibers and after completion of the vibrating step.

Figure 7:
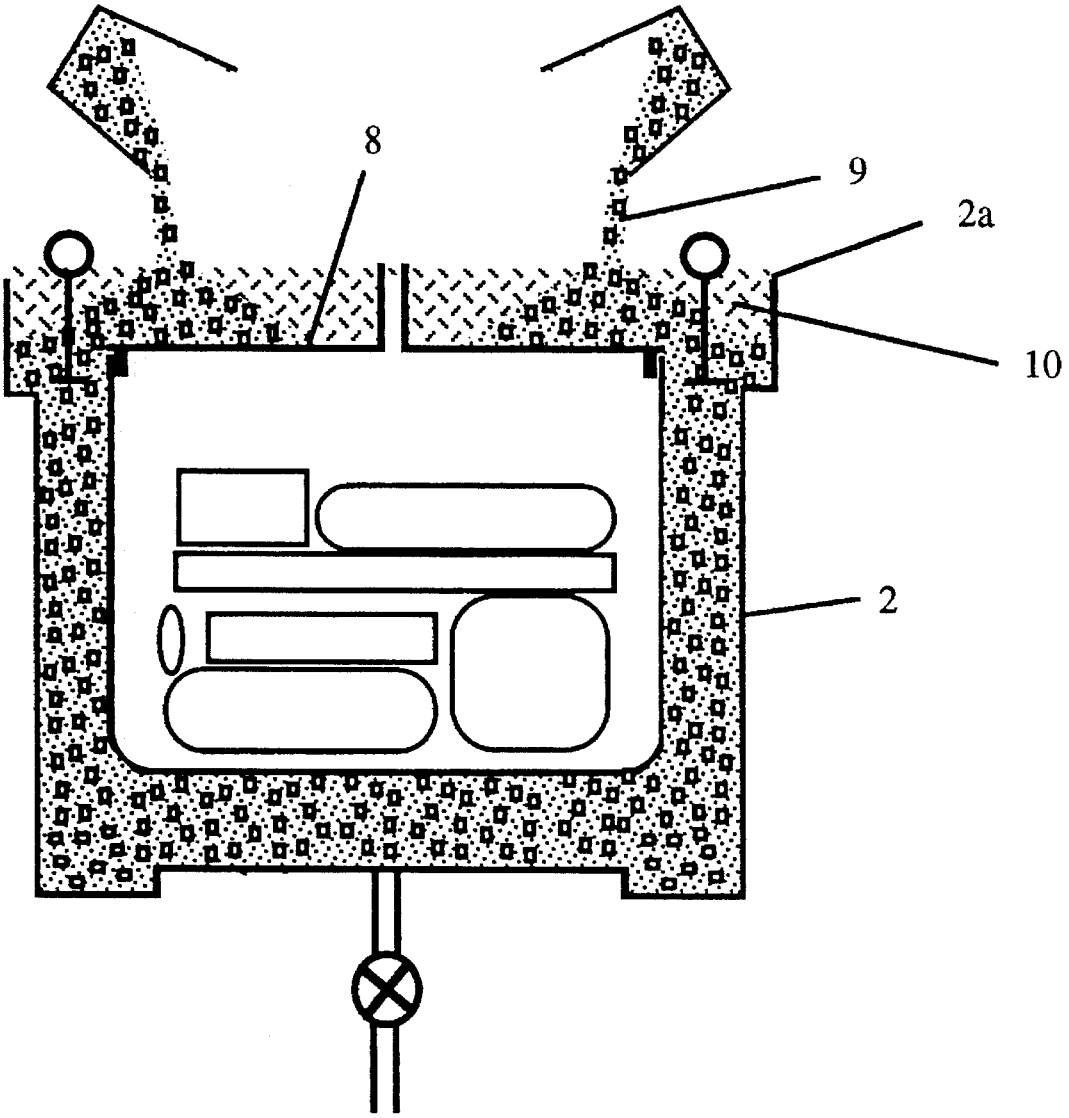
FIG. 7 shows the pouring of concrete onto the cover plate.
Figure 8:
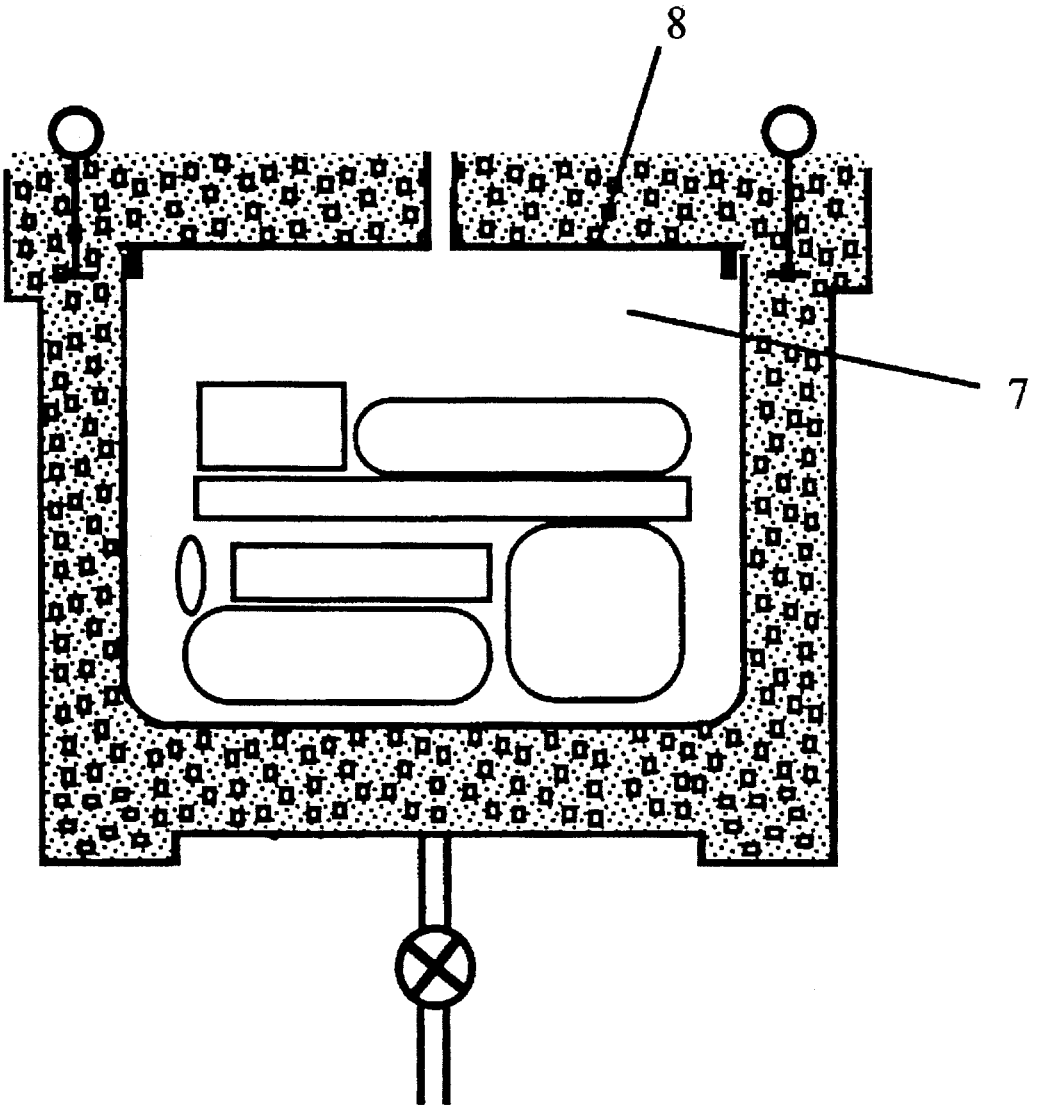
FIG. 8 shows the finished container.

FIG. 7 shows schematically the addition of further cement slurry to fill the mold up to the rim 2*a* of the outer wall 2 thereby embedding the fiber lattice in the cement slurry. Preferably, during pouring or after completion of the pouring step, the mold is vibrated in order to remove any air enclosures within the cement mixture. Subsequently, the cement mixture is allowed to cure and set. FIG. 8 shows the cured container.

It is possible to provide the cover plate 8 with access ports that extend past the upper rim 2*a* of the outer wall 2 so that access to the radioactive material stored within the container is possible after enclosure of the material within the inventive concrete container. The access port may be used to introduce cementitious material into the interior 7 to thereby immobilize and/or encapsulate the radioactive waste material in the interior. It is also possible to use such access ports for monitoring the radioactive material inside the container.

Of course, it is also possible to immobilize and/or encapsulate the radioactive waste material before placing the cover plate 8 onto the container.

By leaving exposed loose and fixed fibers projecting from the concrete mixture in the first phase of the two-phase process, it is possible to provide a continuous fiber lattice upon closure of the container with the cover plate, placing additional fibers onto the cover plate, and ensuring by vibration the intermixing of the already present fiber layer with the later addition of fibers. When pouring the second batch of concrete onto the cover plate, an intimate connection of the initially poured concrete and the later poured concrete is thus ensured.

The inventive two-phase pouring process is a great improvement over the prior art method of producing separate covers and containers in which a separate lid must be placed on the container body and sealed with further cementitious material without having a continuous interconnecting reinforcement lattice (the boundary between actual container and lid represents a break and weak point in the fiber reinforcement structure).

Figure 9:
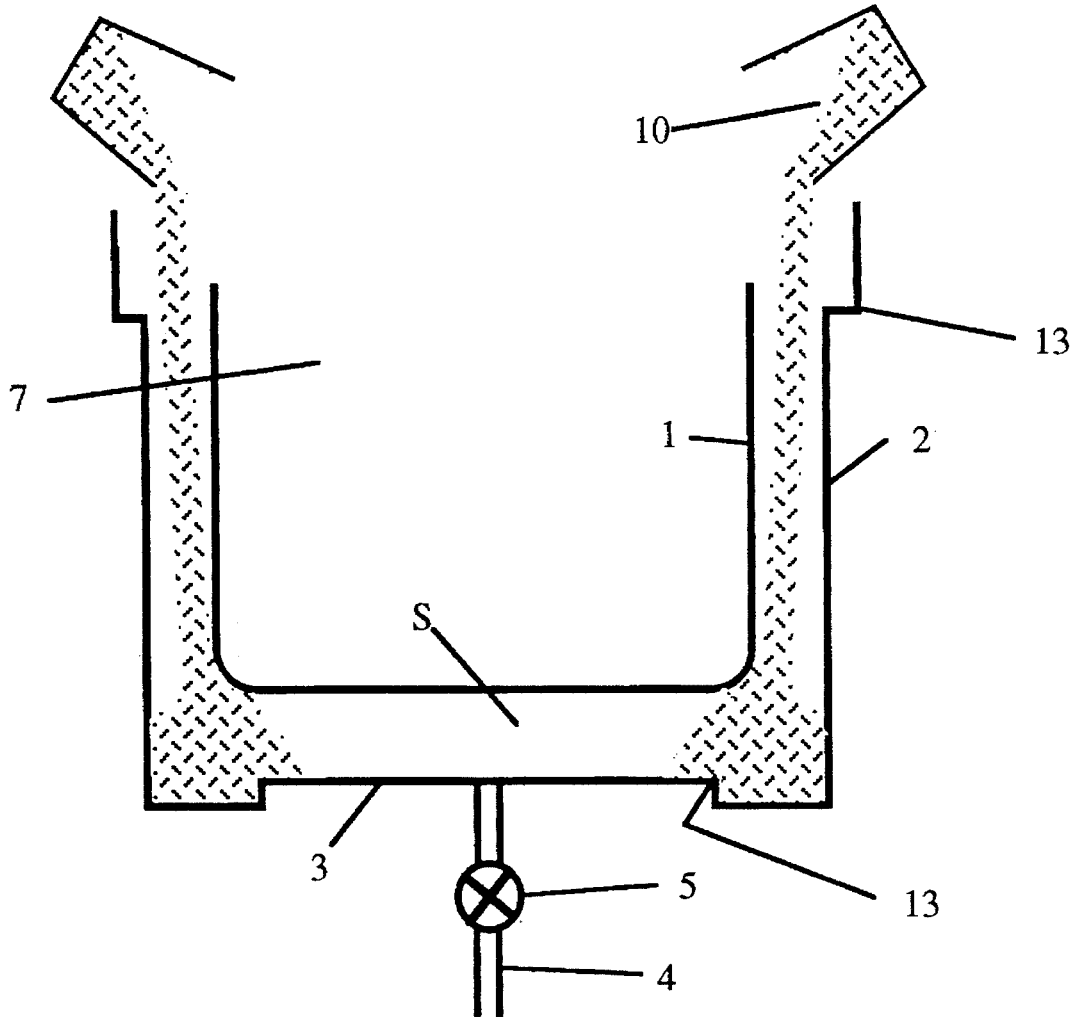
FIG. 9 shows the mold being filled with fibers according to a second embodiment of the method.

According to the second method of the present invention, in which essentially the same mold can be used, fibers 10 are first introduced into the space S between the inner and the outer walls 1, 2 of the mold as shown in FIG. 9. To ensure the uniform distribution of fibers on the bottom of the mold, the inner wall 1 may be introduced into the mold after the bottom fibers are placed. It is possible to introduce the radioactive waste 11 into the interior of the mold before or after this step. Preferably, as described in the first method, the mold is vibrated in order to ensure settling of the fibers and the desired degree of fiber distribution density by volume within the space S of the mold.

Figure 10:
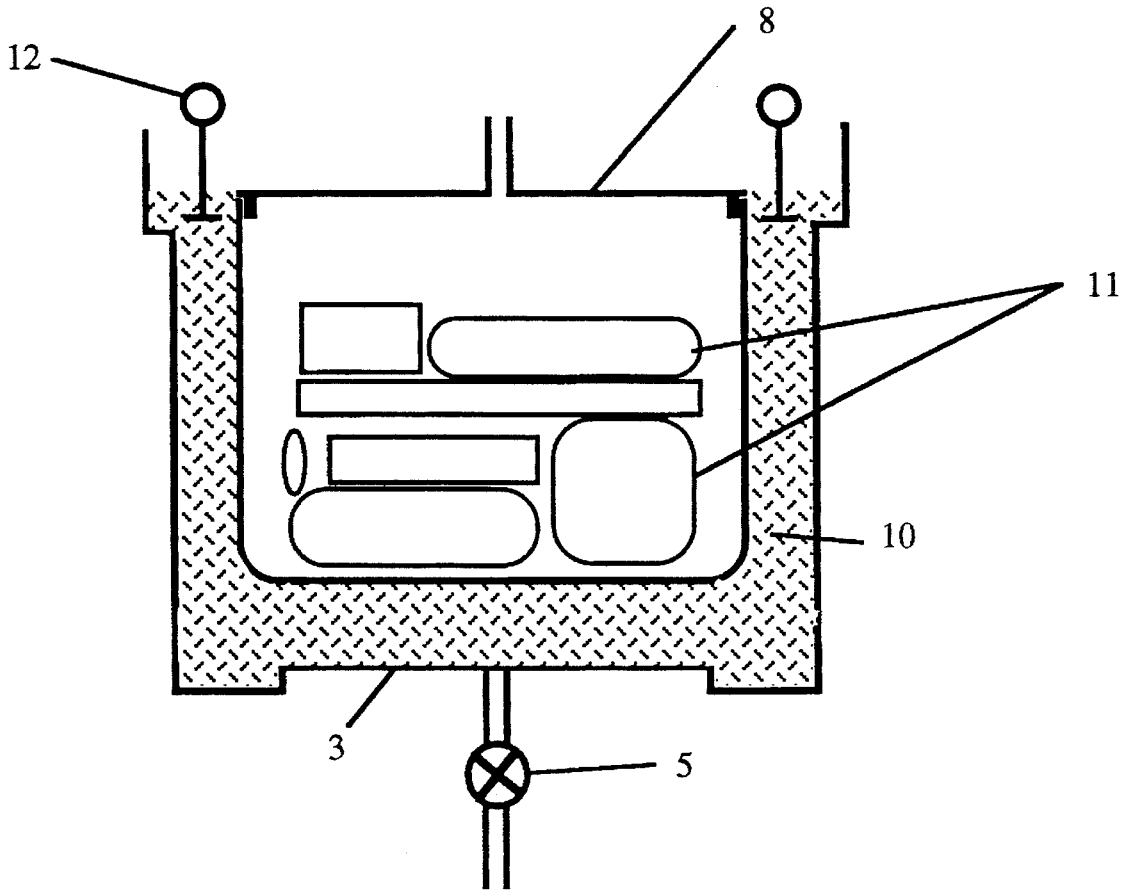
FIG. 10 shows the introduction of radioactive waste and placing of the cover plate.

FIG. 10 shows the cover plate 8 positioned on the inner wall 1 of the mold to close off the interior 7 of the container. Attachment devices 12 can also be placed into the fibers at this time.

Figure 11:
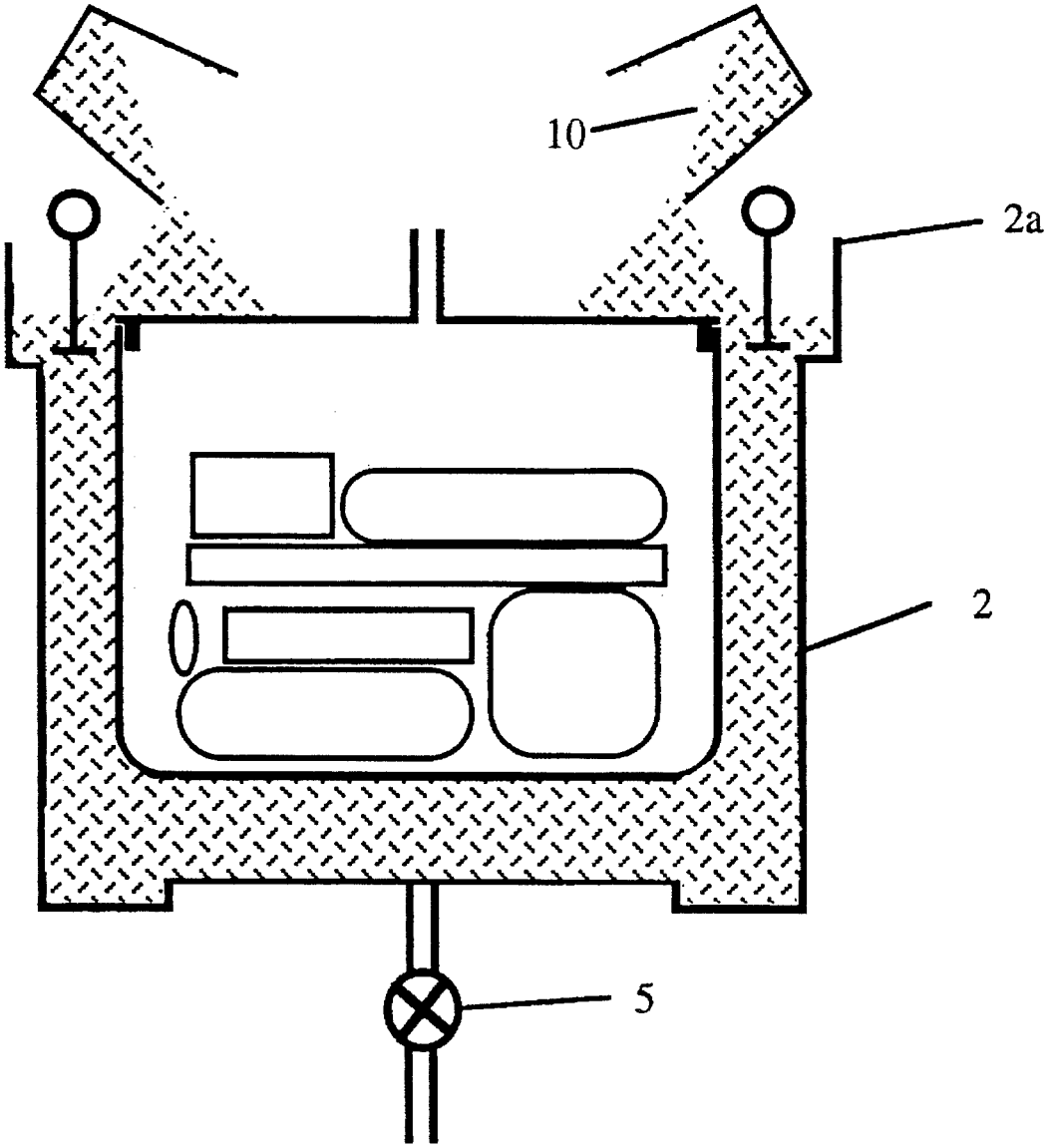
FIG. 11 shows more fibers being added atop the cover plate.

In a subsequent step, as shown in FIG. 11, more fibers 10 are added above the cover plate 8 to fill in the mold to the upper rim 2*a* of the outer wall 2. It is possible to first fill the mold with radioactive waste 11, place the cover plate 8 on top, and then fill the space S as well as the rest of the mold above the cover plate 8 with fibers 10. Advantageously, the mold is again vibrated in order to ensure even distribution of the fibers 10 and the desired fiber density.

Figure 12:
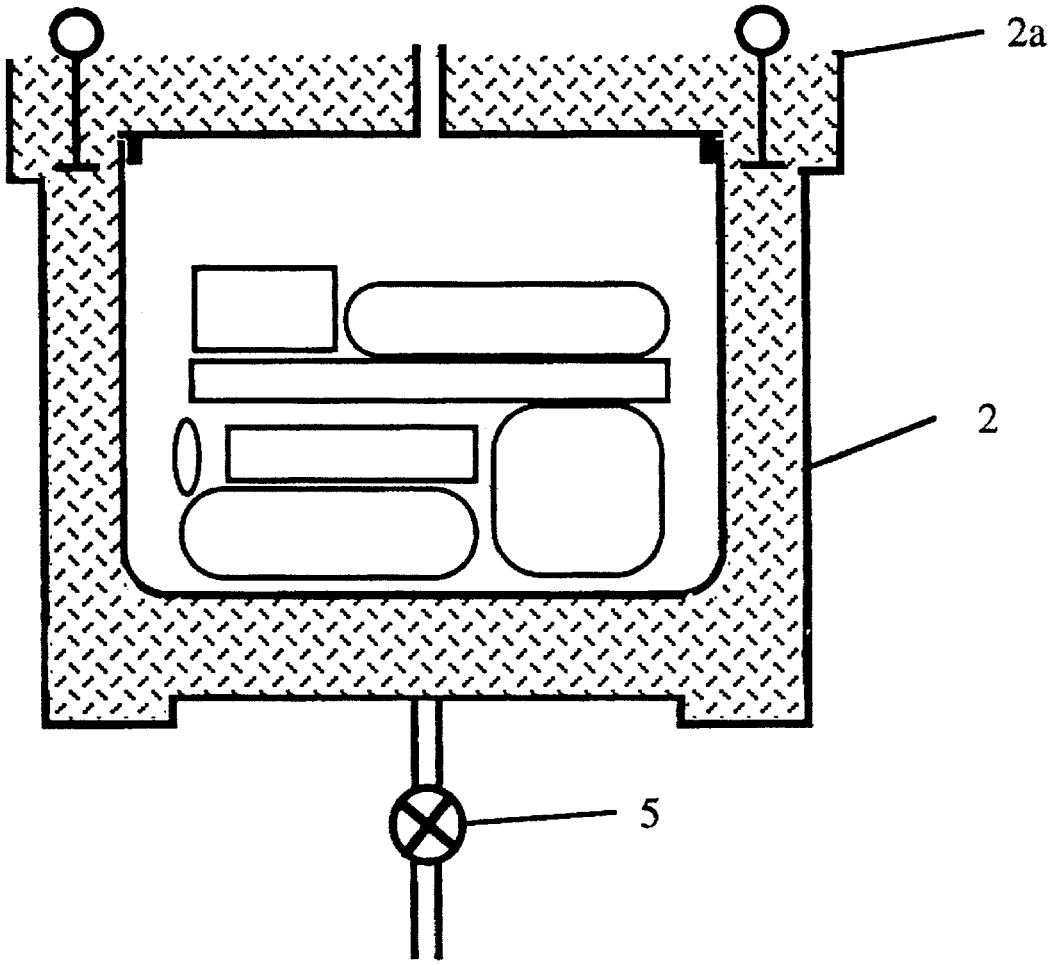
FIG. 12 shows the mold filled to the top with fibers.

FIG. 12 shows the mold ready to be filled with the cement slurry 9 (concrete mixture).

Figure 13:
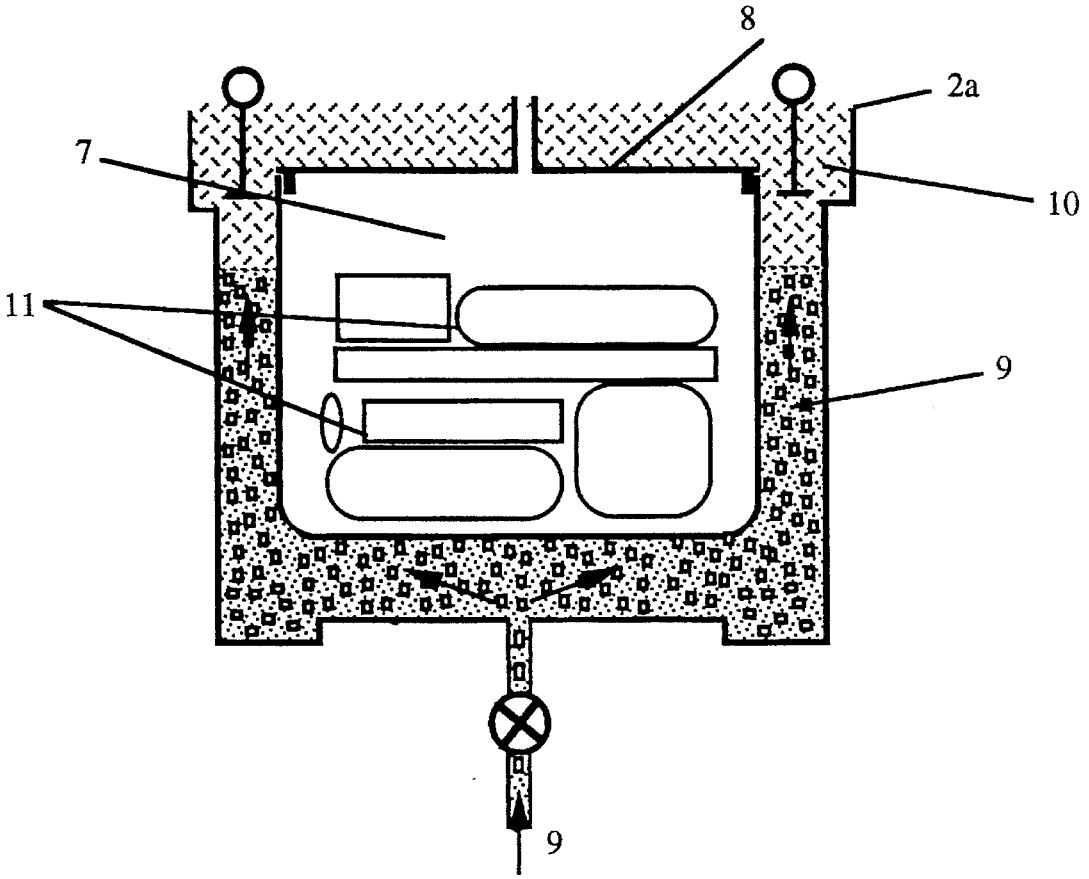
FIG. 13 shows the introduction of concrete into the mold from the bottom.

FIG. 13 schematically shows the filling of the mold with the low viscosity cementitious slurry 9 from the bottom of the mold. The mold preferably is vibrated during and/or after the filling step in order to ensure that no air inclusions remain within the concrete mixture. After filling the mold to the upper rim 2*a* of the outer wall 2 the concrete mixture is allowed to cure.

Figure 14:
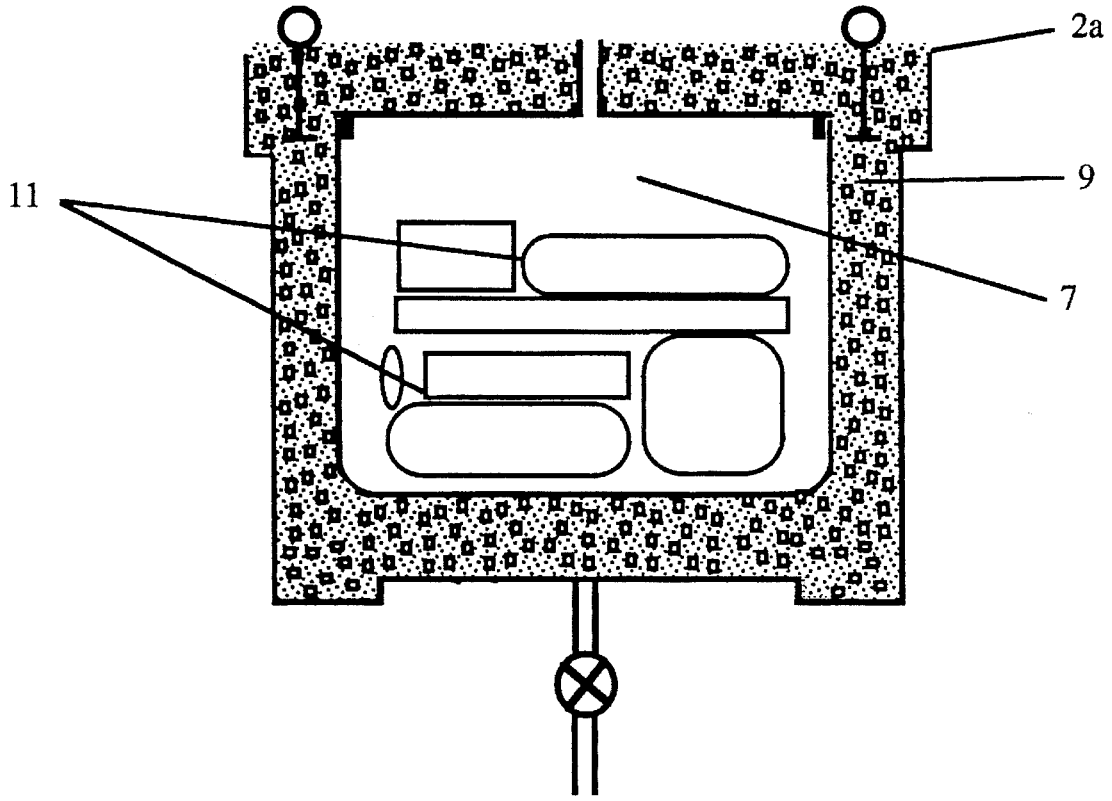
FIG. 14 shows the finished container.

FIG. 14 shows the finished product with inner and outer walls 1, 2 in place.

As described in connection with the first two-phase process of the invention, it is possible to provide the cover plate 8 with access ports so that it is possible, for example, to introduce a cementitious slurry into the interior 7 of the container for embedding or encapsulating the radioactive waste 11 for immobilization purposes. The ports may also be used for allowing access to the interior for the purpose of monitoring the radioactive waste 11 inside the container.

Of course, it would also be possible to encapsulate or immobilize the radioactive waste in the interior 7 of the mold prior to placing the cover plate onto the container body or the mold.

The outer wall 2 and the inner wall 1 in both embodiments may be used as additional radioactive shielding by selecting an appropriate suitable material for this purpose. The cover plate 8 may also be made of radiopaque material for additional shielding. It is, of course, also possible to remove the outer wall 2 from the concrete container in order to reuse the outer wall 2 for future molding processes.

The present invention is, of course, in no way restricted to the specific disclosure of the specification and drawings, but also encompasses any modifications within the scope of the appended claims.

What I claim is:

1. A method of containing radioactive waste in a concrete container for storage of radioactive waste, comprising the steps of:

providing a double-walled mold with an inner wall and an outer wall, the mold being open at the top and providing an interior for receiving the radioactive waste;

filling the space between the inner and the outer walls with fibers;

filling concrete mixture into the space between the inner and the outer walls to a level below the uppermost layer of said fibers;

closing off said interior with a cover plate after introducing the radioactive waste into the interior provided by the mold;

placing more of said fibers onto said cover plate; and pouring concrete mixture onto said fibers until covered completely.

2. A method according to step 1, further comprising the step of vibrating said mold after said step of filling the space between the inner and the outer walls with fibers for increasing the density of fiber distribution to a range of 5–30% by volume.

3. A method according to step 1, further comprising the step of vibrating said mold after said step of placing more of said fibers onto said cover plate for increasing the density of fiber distribution to a range of 5–30% by volume.

4. A method according to claim 1, further comprising the step of curing said concrete mixture after said step of filling concrete mixture into the space between the inner and the outer walls to a level below the uppermost layer of said fibers.

5. A method according to claim 4, further comprising the step of removing said inner wall after said step of curing said concrete mixture.

6. A method according to claim 1, further comprising the step of curing said concrete mixture after said step of pouring concrete mixture onto said fibers until covered completely.

7. A method according to claim 6, further comprising the step of removing said outer wall after curing of said concrete mixture.

8. A method according to claim 1, wherein said outer wall projects upwardly past said inner wall.

9. A method according to claim 1, further comprising the step of connecting an inlet line with a shut-off valve to the bottom of said mold.

10. A method according to claim 9, wherein said step of filling concrete mixture into the space between the inner and the outer walls to a level below the uppermost layer of said fibers includes the step of introducing said concrete mixture through said inlet line.

11. A method according to claim 1, further comprising the step of encapsulating the radioactive waste with cementitious material in said interior.

12. A method according to claim 1, wherein the radioactive waste is introduced into said interior before said step of filling the space between the inner and the outer walls with fibers.

13. A method according to claim 1, wherein the radioactive waste is introduced into said interior after said step of filling the space between the inner and the outer walls with fibers.

14. A method according to claim 1, wherein at least one of said inner wall, said outer wall, and said cover plate is made of a radiopaque material.

15. A method according to claim 1, further comprising the step of positioning an attachment element within said fibers before said step of pouring concrete mixture onto said fibers until covered completely.

16. A method according to claim 1, further comprising the step of vibrating said mold after said step of filling concrete mixture into the space between the inner and the outer walls to a level below the uppermost layer of said fibers.

17. A method according to claim 1, further comprising the step of vibrating said mold after said step of pouring concrete mixture onto said fibers until covered completely.

18. A method according to claim 1, further comprising the step of providing said cover plate with at least one access port extending through said concrete mixture poured onto said cover plate.

19. A method according to claim 1, further comprising the step of vibrating said mold during said step of filling the space between the inner and the outer walls with fibers.

20. A method according to claim 1, further comprising the step of producing recessed portions on the exterior of said container for lifting and transporting.

21. A method according to claim 1, further comprising the step of producing projections on the exterior of said container for lifting and transporting.

22. A method according to claim 21, wherein said projections are attachment elements molded into said concrete mixture.

23. A method of containing radioactive waste in a concrete container for storage of radioactive waste, comprising the steps of:

providing a double-walled mold with an inner wall and an outer wall, the mold being open at the top and providing an interior for receiving the radioactive waste, and placing a cover plate onto the inner wall for closing off said interior after introducing the radioactive waste into the interior provided by the mold;

filling the space between the inner and the outer walls with fibers and placing fibers onto said cover plate;

filling concrete mixture into the space between the inner and the outer walls and onto said fibers on said cover plate until said fibers are covered completely.

24. A method according to claim 23, wherein the radioactive waste is introduced into said interior before said step of filling the space between the inner and the outer walls with fibers.

25. A method according to claim 24, further comprising the step of encapsulating the radioactive waste with cementitious material in said interior.

26. A method according to claim 23, wherein the radioactive waste is introduced into said interior after said step of filling the space between said inner and outer walls with fibers.

27. A method according to claim 26, further comprising the step of encapsulating the radioactive waste with cementitious material in said interior.

28. A method according to claim 23, further comprising the step of vibrating said mold after said step of filling the space between said inner and the outer walls with fibers for increasing the density of fiber distribution to a range of 5–30% by volume.

29. A method according to step 23, further comprising the step of vibrating said mold after said step of placing said fibers onto said cover plate for increasing the density of fiber distribution to a range of 5–30% by volume.

30. A method according to claim 23, further comprising the step of curing said concrete mixture after said step of filling concrete mixture into the space between the inner and the outer walls and onto said fibers on said cover plate until said fibers are covered completely.

31. A method according to claim 30, further comprising the step of removing said outer wall after curing of said concrete mixture.

32. A method according to claim 23, wherein said outer wall projects upwardly past said inner wall.

33. A method according to claim 23, further comprising the step of connecting an inlet line with a shut-off valve to the bottom of said mold.

34. A method according to claim 33, wherein said step of filling concrete mixture into the space between the inner and the outer walls and onto said fibers on said cover plate until said fibers are covered completely includes the step of introducing said concrete mixture through said inlet line.

35. A method according to claim 23, wherein at least one of said inner wall, said outer wall, and said cover plate is made of a radiopaque material.

36. A method according to claim 23, further comprising the step of positioning an attachment element within said fibers before said step of filling concrete mixture into the space between the inner and the outer walls and onto said fibers on said cover plate until said fibers are covered completely, said attachment element projecting from said concrete mixture after filling.

37. A method according to claim 23, further comprising the step of vibrating said mold after said step of filling concrete mixture into the space between the inner and the outer walls and onto said fibers on said cover plate until said fibers are covered completely.

38. A method according to claim 23, further comprising the step of providing said cover plate with at least one access port extending through said concrete mixture after filling.

39. A method according to claim 23, further comprising the step of vibrating said mold during said step of filling the space between the inner and the outer walls with fibers.

40. A method according to claim 23, further comprising the step of producing recessed portions on the exterior of said container for lifting and transporting.

41. A method according to claim 23, further comprising the step of producing projections on the exterior of said container for lifting and transporting.

42. A method according to claim 41, wherein said projections are attachment elements molded into said concrete mixture.

* * * * *